United States Patent [19]

Peze et al.

[11] Patent Number: 4,688,631

[45] Date of Patent: Aug. 25, 1987

[54] PLATE HEAT EXCHANGER

[75] Inventors: André Peze, Renaison; Henry Fechner, Le Coteau, both of France

[73] Assignee: Barriquand Societe Anonyme, Roanne, France

[21] Appl. No.: 811,280

[22] Filed: Dec. 20, 1985

[30] Foreign Application Priority Data

Dec. 21, 1984 [FR] France ..... 84 19707

[51] Int. Cl.[4] ..... F28F 3/00

[52] U.S. Cl. ..... 165/166; 29/157.3 D

[58] Field of Search ..... 165/166, 167

[56] References Cited

U.S. PATENT DOCUMENTS

| | | | |
|---|---|---|---|
| 2,169,993 | 8/1922 | Booth | 257/139 |
| 2,586,118 | 2/1952 | Teller | 165/166 |
| 3,228,464 | 1/1966 | Stein et al. | 165/166 |
| 3,428,141 | 2/1969 | Forstner et al. | 180/54 |
| 3,464,488 | 9/1969 | Mazmsater | 165/166 |

FOREIGN PATENT DOCUMENTS

| | | | |
|---|---|---|---|
| 2163731 | 11/1971 | Fed. Rep. of Germany . | |
| 998449 | 1/1952 | France . | |
| 1389144 | 1/1965 | France . | |
| 2067079 | 8/1971 | France . | |
| 0137459 | 11/1978 | Japan | 165/166 |
| 822421 | 10/1959 | United Kingdom . | |
| 0823951 | 11/1959 | United Kingdom | 165/166 |
| 1253307 | 11/1971 | United Kingdom . | |
| 2109712 | 6/1983 | United Kingdom . | |

*Primary Examiner*—Albert W. Davis, Jr.
*Assistant Examiner*—Richard R. Cole
*Attorney, Agent, or Firm*—Willian Brinks Olds Hofer Gilson & Lione Ltd.

[57] ABSTRACT

Plate exchanger of the type comprising a plurality of juxtaposed metallic plates defining spaces between them, every other of which spaces receives a flow of a first fluid whereas the other spaces receive a flow of a second fluid, substantially parallel to the first, each plate being joined in tight manner, by its periphery to the two adjacent plates, while inlet or outlet orifices are provided for the fluids, the plates being paired up by straight seam welding in two opposite end parts of the plates of each pair of plates, characterized in that one plate at least from each pair comprises a flange, at least in one of the end parts and close to said welding, which flange is bent substantially at right angle and joined by straight welding of its free bordering part to a plate facing the next pair.

17 Claims, 13 Drawing Figures

Figure 1:
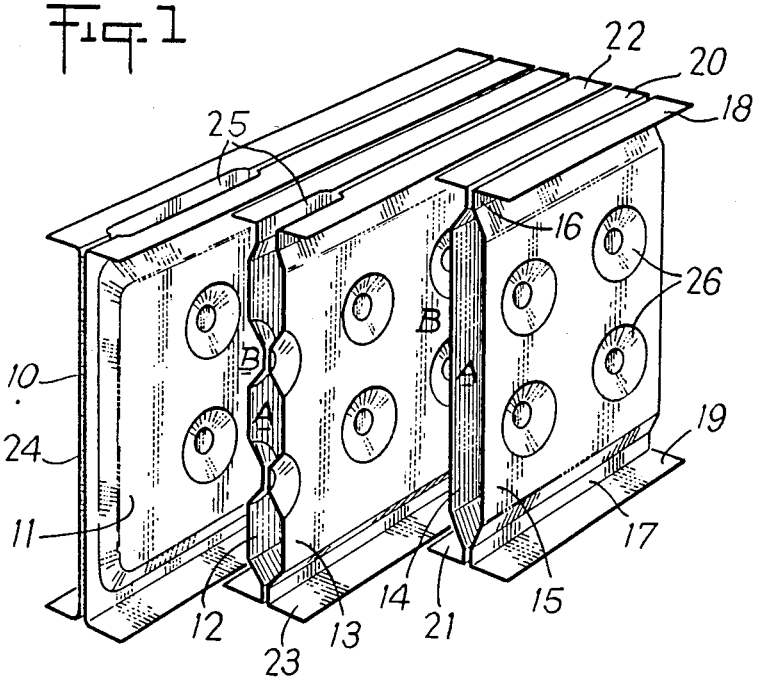

Fig. 5
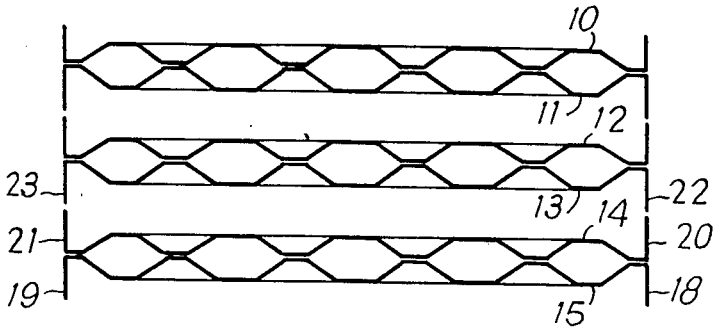
Fig. 7
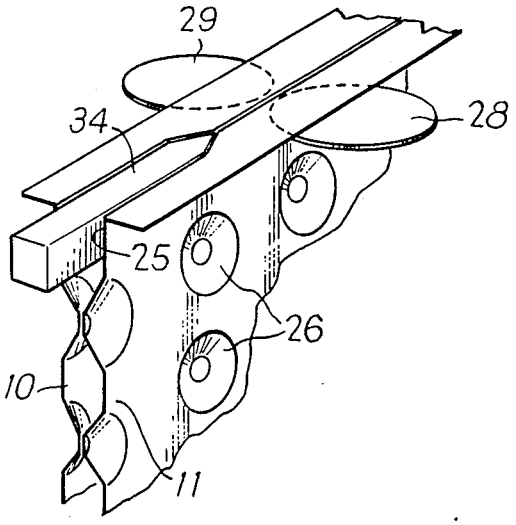
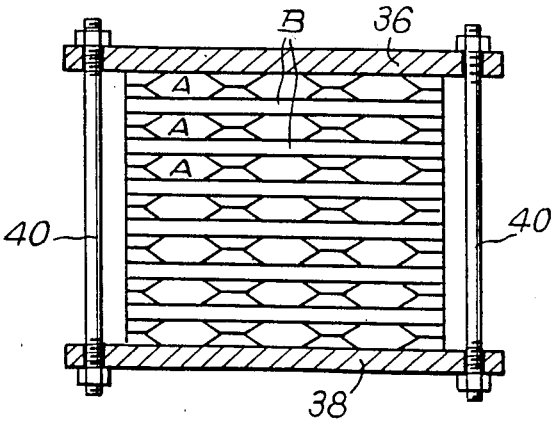
Fig. 6

Fig. 8
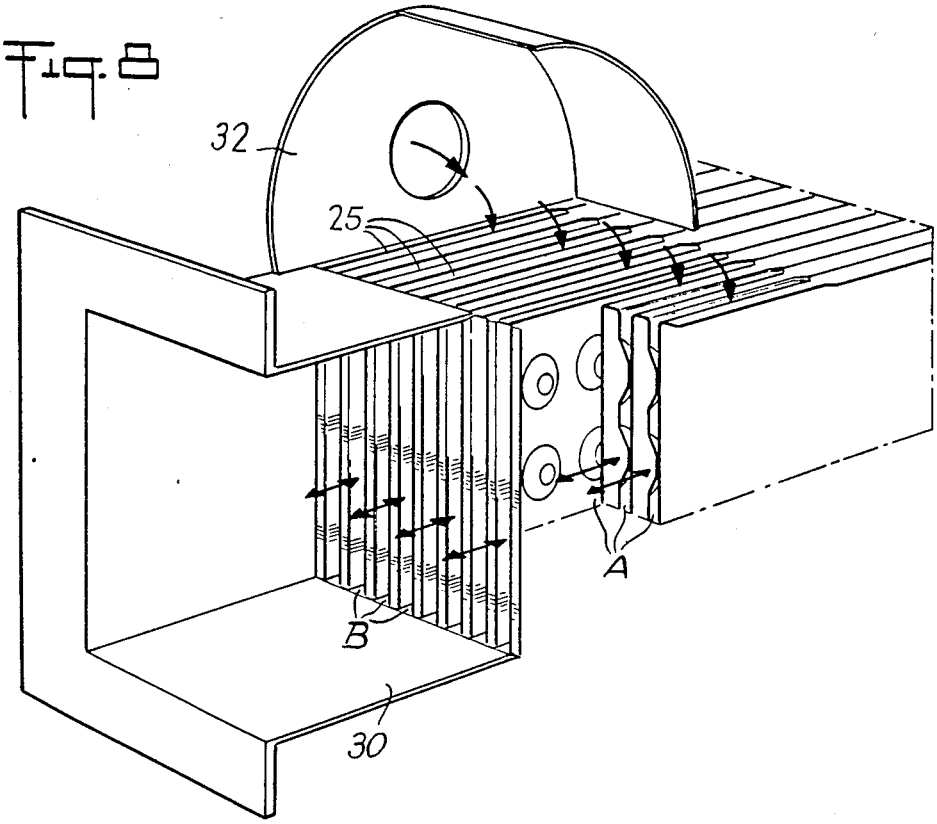
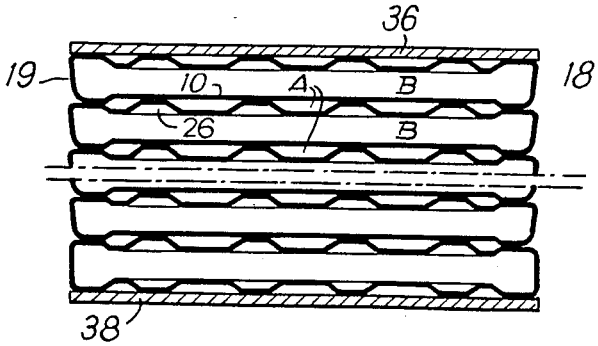
Fig. 9
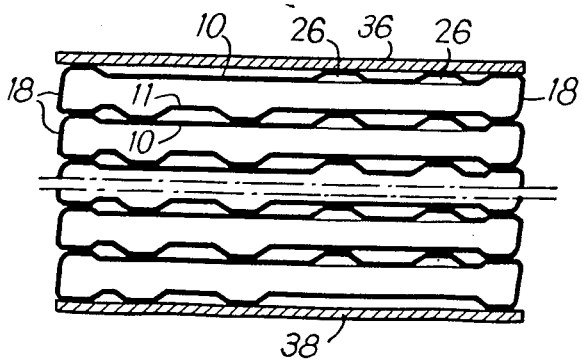
Fig. 10

PLATE HEAT EXCHANGER

The present invention relates to a plate heat exchanger.

The conventional plate heat exchangers are produced by stacking a plurality of plates with interposition of joints between successive plates, said joints being open in parts in order to connect the intermediate spaces or gaps created between two plates, with fluid inlet and return collectors. In known manner, the successive spaces are thus connected, alternately, with inlet and return collectors conveying a first fluid and with inlet and return collectors conveying a second fluid, the term fluid, as used here, covering all types of liquids and gases, the two fluids exchanging heat energy through the plates while flowing through the intervals between the plates.

The presence of said joints limits the field of utilization of these heat exchangers, especially with regard to the temperature, the pressure and to certain fluids, such as corrosive fluids (acids) or solvents.

Finally, in order to keep the plates in stacked condition, it is absolutely necessary to provide supporting plates on the ends of the stack, these supporting plates being joined one to the other by tie-pieces distributed on the periphery of the exchanger plates. The resistance of the supporting plates and of the tie-pieces is conditioned by the highest of the pressures of the two fluids flowing through the exchanger.

Solutions have already been proposed to avoid the presence of joints, in which the plates are welded together on their periphery.

According to a first solution, each plate is welded to one adjacent plate along two opposite edges, and to the other adjacent plate by its two other opposite edges, so that necessarily fluids must flow through the gaps between successive plates in crossed directions.

According to a second solution, permitting fluid flows in parallel directions, the plates are first welded in pairs on at least two opposite edges, and the formed pairs are re-grouped inside a housing structure, which is often simply constituted by obturating strips welded on one side to one pair of plates, along the same edges, and on the other side, to another pair of plates, optionally one adjacent to the first.

It is found, with this last solution, that the number of welding seams is greatly multiplied, some being often superimposed, which, costs left aside, causes metallurgical distortions in the metal, close to the plates. Finally, in cases of welding fractures, it is particularly difficult to carry out repairs without removing beforehand some of the obturation strips. In certain parts, there is often such an accumulation of the metal from the plates of the exchanger and of the welding metal that said exchangers have difficulties in withstanding the differential expansions.

It is the object of the present invention to overcome the aforesaid drawbacks by proposing a plate exchanger comprising a plurality of juxtaposed metallic plates defining spaces betweeen them, every other of which spaces receives a flow of a first fluid whereas the other spaces receive a flow of a second fluid, substantially parallel to the first, each plate being joined in tight manner, by its periphery to the two adjacent plates, while inlet or outlet orifices are provided for said fluids, said plates being paired up by straight seam welding in two opposite end parts of the plates of each pair of plates, characterized in that, one plate at least from each pair comprises a flange, at least in one of said end parts and close to said welding, which flange is bent substantially at right angle and joined by straight welding of its free bordering part to a plate facing the next pair.

The invention will be more readily understood on reading the following description with reference to the accompanying drawings, in which:

FIG. 1 is a partly stripped perspective of a heat exchanger according to the invention, FIGS. 2, 3, 4, 5 and 6 are views illustrating the design and assembly of the plates of the heat exchanger according to FIG. 1, seen in cross-section, FIG. 7 is a perspective view showing a detail of assembly of two plates of the heat exchanger, FIG. 8 is an overall perspective with stripped portions, of one end of the fully assembled heat exchanger, and FIGS. 9 to 13 are similar views to that shown in FIG. 6, illustrating different variants of the embodiment.

The exchanger according to the invention is composed of a stack of juxtaposed metallic plates of substantially rectangular shape, and, FIG. 1 shows six of such plates 10, 11, 12, 13, 14 and 15, some of which are shown in cross-section in order to emphasize the special method of assembly used.

First, it is noted that the plates are assembled in pairs 10–11, 12–13 and 14–15.

The first pair, 10–11 is shown as far as its front edge, whereas the other two pairs have been cross-sectioned according to different transversal vertical planes.

The plates of each pair define between them a space designated by reference A, and the pairs define together spaces designated by reference B. As conventionally known, spaces A are designed to receive the flow of a first fluid and spaces B are designed to receive the flow of a second fluid, the aim being to ensure an exchange of heat between them through the plates.

Spaces A and B are closed off, at least at the top and at the bottom, by the fact that each plate is joined in tight manner by its periphery to two adjacent plates. The plates of one pair, for example 14–15, are welded together by straight weldings seams 16 and 17 in their upper and lower end part. According to the invention, said weldings may be produced for example by the electrical seam welding method, using a contact wheel, as explained hereinafter.

The plates have flanges 18, 19, 20, 21 joined together by their upper and lower borders and bent substantially at right angles, this permitting interconnection of the pairs of plates.

In the illustrated example, the pairs are assembled one alongside the other, so that the flanges 20, 21 of one plate (14) of a first pair of plates (14–15) are placed edge-to-edge with respect to the flanges (22,23) of the plate 13 facing the next pair (12–13) and the flanges are welded together (20 and 22, 21 and 23) by a straight welding seam, using for example the arc welding method.

As illustrated in FIG. 1, the two plates of one pair (10–11) are also welded together along their front border 24, either by electric seam welding or arc seam welding.

Conceivably, the same thing occurs with the rear borders of the plates, but this is not illustrated, for convenience's sake.

Orifices for the admission or discharge of the fluid towards spaces A are provided in the form of interruption in the upper 16 and lower 17 welding seams. Only one orifice 25 is illustrated in FIG. 1, at the level of the upper seam, and close to the front 24. The other orifice, not shown, is situated close to the rear, either on the level of the upper seam 16 or of the lower seam 17.

The pairs of plates have no flanges in their rear and front end portions, so that there are free openings between the pairs of plates, these constituting inlet and outlet orifices for the fluid flowing through spaces B.

Finally, according to FIG. 1, the plates are provided with depressions 26 distributed substantially regularly on the surface of the plate and having multiple uses.

Firstly, when the two plates of one pair are assembled (12–13), their depressions 26 are brought in mutual contact, this giving a constant width to spaces A, even when the fluid pressure prevailing in space B exceeds the pressure prevailing in spaces A.

Secondly, the plates are welded together by spot welding on the bottom of the depressions, this preventing the plates from coming apart when, on the contrary,the fluid pressure prevailing in spaces A exceeds that prevailing in spaces B.

Thirdly, said depressions create obstacles to the flow of fluid through spaces B and the created turbulences improve the heat exchanges between the fluid and the plates.

Said depressions may be arranged in regular rows such as illustrated, or staggered or placed according to any predetermined configuration.

The plate forming and assembling sequence is illustrated in FIGS. 2 to 7, in which the plates are diagrammatically shown in cross-section.

Figure 2:
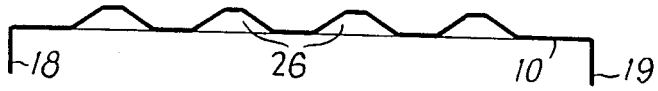

The isolated plate 10 illustrated in FIG. 2 has been produced in the conventional way by stamping depressions 26 and bending flanges at right angle.

Figure 3:
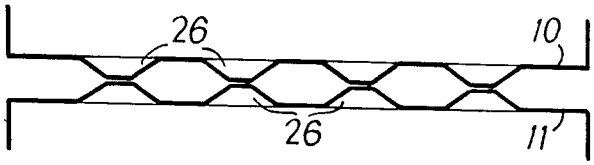
Figure 4:
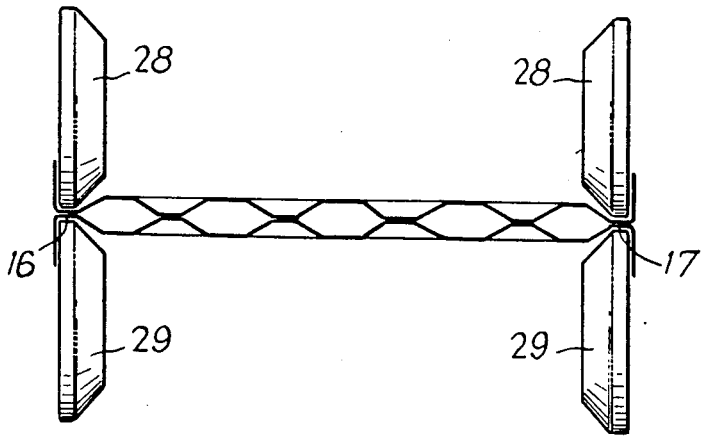

Said plate is then assembled to a second plate 11 by spot welding on the bottom of the depressions 26 (FIG. 3).

Welding seams 16, 17 are then produced close to the base of the flanges, by electric welding using contact wheels 28, 29 (FIG. 4), a fact to be noted being that the plates initially at a distance one from the other (FIG. 3), are forced close together under the pressure of the contact wheels. This is made possible by the thinness of the plates and by the short distance between them, thus avoiding a conforming operation beforehand.

A first pair of plates (10–11) is then assembled to a second pair of plates (12–13) constituted as described hereinabove, the flanges of both pairs being placed one alongside the other, and a straight welding seam being made for example by the arc welding method.

The number of pairs of plates required for obtaining the desired exchange surface is thus assembled.

The assembled plates form a monobloc assembly to which are operationally coupled inlet and outlet collectors for the fluids flowing through spaces A and B.

As illustrated in FIG. 8, a collector 30, forming a rectangular channel is welded to the perimeter of the front end of the exchanger plates. A similar collector, not shown, is welded to the perimeter of the rear end of said exchanger plates, both collectors serving to convey the fluid flowing through spaces B.

A semi-cylindrical collector 32 is welded crosswise to the plate assembly, in such a way as to cover up all the orifices 25 provided for the fluid flowing through spaces A.

The front edge (according to the embodiment illustrated in FIG. 8) of collector 32 is welded to the upper face of collector 30, and its rear edge is welded to a pseudo-plane and quasi-continuous surface, formed by the succession of flanges of the exchanger plates. These weldings are preferably performed with injection of metal in order to ensure the required tightness.

As a variant, the front edge of the collector 32 may also be welded to the flanges of the exchanger plates, as long as orifices 25 are provided somewhat away from the front edges 24 of the plates.

The detail illustrated in FIG. 7 helps to understand how orifices 25 are produced. A wedge 34 is introduced between two plates of one pair of plates 10–11 so as to prevent the contact wheels 28, 29 from advancing into the orifice zone. It is also possible to do without such a wedge 34 and simply to stop the advancing movement of the contact wheels in a predetermined spot, provided that the plates are held apart by the presence of the depressions 26 forming spacing members. Whatever the case, it is important to note that the plate flanges project over a greater distance at the level of the orifices and accordingly to plan a cutting operation so as to give the flanges a rectilinear edge, but in practice this should not always be necessary insofar as the gaps are only a few millimeters thick.

Given that the pairs of plates are spot-welded together on the bottom of depressions 26, the pressure of the fluid flowing through spaces A has no effect on the exchanger.

On the contary, when the fluid flowing through spaces B has a certain amount of pressure, support plates 36, 38 have to be provided close to the exchanger plates situated at the ends (FIG. 6). Said support plates are juxtaposed, but not fastened, to the exchanger plates so as to allow a differential expansion, and they are joined together by tie-pieces 40, cut to size and distributed so as to withstand the stresses due to the pressure of the fluid flowing through spaces B.

From the basic embodiment described hereinabove, different variants have been worked out non-restrictively, such as those illustrated in FIGS. 9 to 13.

In FIG. 9, only every other plate is provided with the flanges 18, 19, the other plates have none.

In this particular variant, the plates having been assembled in pairs, the pairs are assembled together by welding the flanges of one plate directly to the edges of a flangeless plate of the next pair.

As illustrated, the plates provided with flanges are entirely flat and the plates without flanges have depressions 26. Therefore the two plates are of a different type, and the operations conducted on them are different: bending in one case, stamping in another.

In FIG. 10, all the exchanger plates are identical and provided with a flange 18 on only one edge, and with depressions over part of their surface.

To make up the pairs, the plates are laid head-to-foot, and the pairs are assembled together as hereinabove, by welding the edges of the flanges to the edges of the facing plates.

Figure 11:
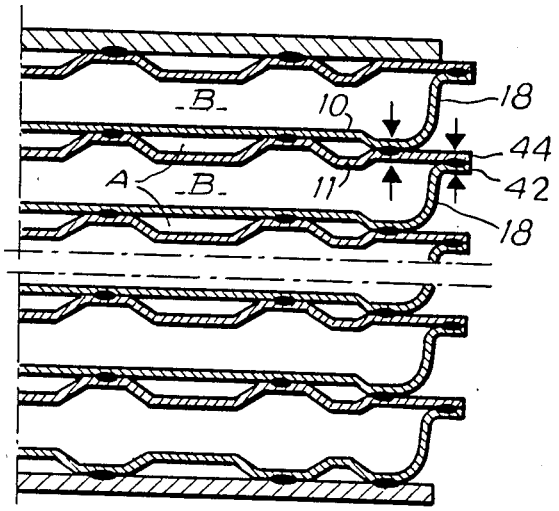

In FIG. 11, the flanges are extended by flat border 42, and the ends of the flangeless plates are provided with an extension 44. Said flat border and extensions are flat-welded by the electric seam welding method.

In this case however, it is important to make allowances for the projections created by the borders and extensions when assembling the semi-cylindrical collectors for the fluid flowing through spaces A. For example, notches may be provided at regular intervals along the rear edge of the collector, in order to receive these projections.

Figure 12:
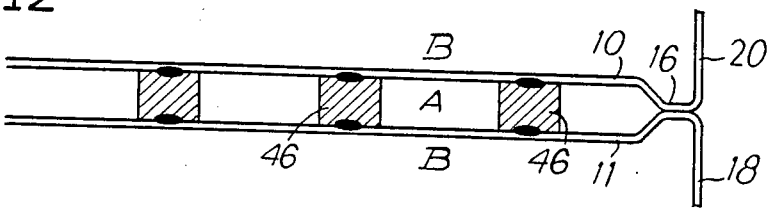

According to the variant illustrated in FIG. 12, the exchanger plates are entirely flat and when they are joined into pairs, metallic spacing-pieces 46 are interposed between them, said spacing-pieces being spot-welded to the two plates.

Figure 13:
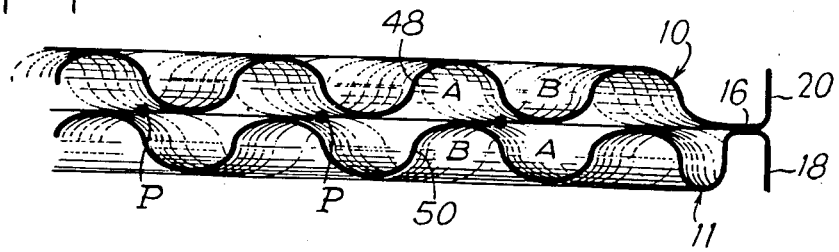

According to the variant illustrated in FIG. 13, the plates are of the corrugated type, the corrugations(48) of one being oriented differently from the corrugations (50) of the adjacent plate.

The plates are paired up by welding their edges with a contact wheel, as described hereinabove. Another possibility is to join the two plates by spot welding in those areas where the crests of the corrugations of one are in contact with the hollows of the corrugations of the other, as illustrated by black spots P in the figure.

The common factor in the structure of these different variants is therefore the fact that the plates are bonded together by pairs by straight seam welding without any addition of metal, in two opposite end zones, and that at least one plate in every pair is provided with a flange situated in at least one of said end zones and close to said straight welding, said flange being bent at right angle and straight-welded, in its free bordering zone, to the facing plate of the next pair of plates.

The invention, such as described in details in the foregoing, present the following essential advantages:

All the exchanger plates form a monobloc assembly which may be treated and handled as a single unit.

It is no longer necessary to enclose the plates assembly inside a housing structure, since the assembly in itself has its own such structure, and as a result the exchanger is especially light.

All the welding seams between the plates are directly accessible from the outside, either for checks or for repairs.

When only the fluid flowing through space A is pressurized, there is no need to provide any reinforcement plates joined up by tie-pieces The spaces B are free of obstacles and accessible through orifices situated in alignment, so that fluid containing impurities can be flowed therethrough without any risk of clogging up occurring, or if there should be any clogging up, this would be particularly easy to clear.

This particular construction of exchangers is extremely appropriate for pre-manufacture, and this on several levels :

(a) shaping of the exchanger plates, (b) joining of the plates into pairs, (c) assembling of a predetermined number of plates, (d) assembling of inlet/outlet collectors for the fluid "B".

Other possibilities will be obvious to anyone skilled in the art:

When the pressure of the fluid flowing through spaces B is relatively low, the reinforcing end-strips can be fastened directly to the plates, without the need of tie-pieces, the tensile stresses being absorbed by the succession of flanges from the welded plates.

All the plates being in perfectly sealed contact, their temperature will therefore be very even and the phenomena of differential expansion are negligible.

All the welding lines between plates may be performed by automatic machines, this increasing reliability for a reduced cost.

What is claimed is:

1. Plate exchanger of the type comprising a plurality of juxtaposed metallic plates defining spaces between them, every other of which spaces receives a flow of a first fluid whereas the other spaces receive a flow of a second fluid, substantially parallel to the first, each plate being joined in tight manner, by its periphery to the two adjacent plates, while inlet or outlet orifices are provided for said fluids, said plates being paired up by straight seam welding in two opposite bordering parts of the plates of each pair of plates, characterized in that one plate at least from each pair comprises a flange, at least in one of said bordering parts and close to said welding, which flange is bent substantially at right angle and joined by straight welding of its free edge to a plate facing the next pair.

2. Exchanger as claimed in claim 1, wherein the plates of one pair of plates are joined together by spot-welding their surfaces.

3. Exchanger as claimed in claim 2, wherein the plates comprise depressions and the welding spots are situated on the bottom of said depressions.

4. Exchanger as claimed in claim 2, wherein said plates are flat and said welding spots are made through spacing-pieces interposed between said plates.

5. Exchanger as claimed in claim 2, wherein said plates comprise corrugations of different orientations.

6. Exchanger as claimed in claim 1, wherein the straight welding between the plates of one pair of plates is performed by the electric seam welding method, using a compact wheel.

7. Exchanger as claimed in claim 6, wherein the straight welding seam made between the plates of one pair of plates is interrupted locally so as to create orifices for a fluid flowing through the space left between the plate.

8. Exchanger as claimed in claim 1, wherein the straight welding seam between the flange of one plate and the facing plate is produced by the arc welding method.

9. Exchanger as claimed in claim 1, wherein each plate comprises a flange in its two opposite bordering parts.

10. Exchanger as claimed in claim 1, wherein each plate comprises a flange in only one of its two opposite bordering parts.

11. Exchanger as claimed in claim 1, wherein each pair of plates is composed of one flangeless plate and of one plate with flanges in its two opposite bordering parts.

12. Exchanger as claimed in claim 1, wherein each pair of plates is composed of one plate provided with depressions.

13. A plate heat exchanger of the type for exchanging heat between a first and second fluid, the heat exchanger comprising:

a plurality of pairs of metallic plates, the plates of each pair joined together to define a plurality of sealed first spaces with first fluid inlet and outlet openings, at least one plate of each pair comprising a flange located on an end with at least one of (1) the inlet opening and (2) the outlet opening, the flange extending substantially at 90° with respect to the plane of the pair of plates and joined to one of the adjacent pair of plates to create a plurality of sealed second spaces with second fluid inlet and outlet openings between the pairs of plates such that fluid flowing in the second spaces will flow substantially parallel to fluid flowing in the first spaces.

14. The invention of claim 13 wherein the plates comprise depressions and wherein the plates of each pair are joined together by spot-welding at the bottom of selected ones of the depression.

15. The invention of claim 13 wherein the plates of each pair are flat and joined together by spacing pieces interposed between the plates.

16. The invention of claim 13 wherein each plate comprises an additional flange located at the end opposite the end with the flange.

17. A plate heat exchanger for exchanging heat between a first and second fluid, the heat exchanger comprising:

a plurality of juxtaposed pairs of metallic rectangular plates, each plate comprising a plurality of surface formations operative to engage at least one adjacent plate, the plates of each pair joined together at least one of the surface formations and along a first end and along a second end opposite the first end to define a plurality of sealed first spaces with inlet openings located on the first end and outlet openings located on the second end, the first space receiving flow of a first fluid substantially in a first direction, each plate comprising a flange along the edges of the respective end containing the inlet and outlet openings, the flanges of each plate bent at substantially right angles to join the flanges of the adjacent plates and form a plurality of sealed second spaces between the pairs of plates with inlet and outlet openings, the second spaces receiving flow of a second fluid in a direction substantially parallel to the first direction.

* * * * *